US010381777B2

(12) United States Patent
Hamada et al.

(10) Patent No.: US 10,381,777 B2
(45) Date of Patent: Aug. 13, 2019

(54) LEVER-TYPE CONNECTOR

(71) Applicant: Sumitomo Wiring Systems, Ltd., Yokkaichi, Mie (JP)

(72) Inventors: Yusuke Hamada, Mie (JP); Keisuke Teramoto, Mie (JP); Hiroko Nishii, Mie (JP); Yuichi Goto, Mie (JP); Yoshihiro Mizutani, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/031,048

(22) Filed: Jul. 10, 2018

(65) Prior Publication Data

US 2019/0027864 A1 Jan. 24, 2019

(30) Foreign Application Priority Data

Jul. 18, 2017 (JP) ..... 2017-138771

(51) Int. Cl.
*H01R 13/62* (2006.01)
*H01R 13/629* (2006.01)

(52) U.S. Cl.
CPC ..... *H01R 13/62955* (2013.01); *H01R 13/62938* (2013.01)

(58) Field of Classification Search
CPC ..... H01R 13/62938; H01R 13/633; H01R 13/62933; G06K 13/08
USPC ..... 439/157, 159, 160, 372
See application file for complete search history.

(56) References Cited

U.S. PATENT DOCUMENTS 5,344,194 A * 9/1994 Hatagishi ..... H01R 13/62933 285/26
6,881,081 B2 * 4/2005 Gundernnann .. H01R 13/62944 439/157
6,982,393 B2 * 1/2006 Matsui ..... H01R 13/62933 200/332
8,033,843 B2 * 10/2011 Ambo ..... H01R 13/62955 439/157
8,353,712 B2 * 1/2013 Makino ..... H01R 13/62938 439/157
8,764,474 B2 * 7/2014 Sakaguchi ..... H01R 13/72 439/157
8,915,749 B2 * 12/2014 Ikeda ..... H01R 13/62938 439/157

FOREIGN PATENT DOCUMENTS

JP 2010-140867 6/2010

* cited by examiner

*Primary Examiner* — Thanh Tam T Le
(74) *Attorney, Agent, or Firm* — Gerald E. Hespos; Michael J. Porco; Matthew T. Hespos

(57) ABSTRACT

A connector includes a housing (10) that is connectable to a mating connector by rotating a lever (40) from an initial position to a connection position on the housing (10). The lever (40) has two arm plates (41) coupled by an operating portion (42). Ridge pieces (44) are on facing surfaces of the arm plates (41). Front and rear rails (22A, 22B) extend perpendicular to a pull-out direction of wires to guide the ridge piece (44) laterally. An introducing portion (26) is open on one end of the rear rail (22B) to receive the ridge piece (44) between the rails (22A, 22B) from a position behind the housing (10). An escaping portion enables the ridge piece (44) to rotate from a position between the rails to the position behind the housing (10) as the lever (40) is rotated from the connection position to the initial position.

3 Claims, 23 Drawing Sheets

LEVER-TYPE CONNECTOR

BACKGROUND

Field of the Invention

This specification relates to a lever-type connector.

Description of the Related Art

Japanese Unexamined Patent Publication No. 2010-140867 discloses a connector with a lever for connection to a mating connector. This lever-type connector includes a housing, a lever and terminal fittings. The housing is provided with a lever accommodation recess and a cylindrical support shaft constituting a pivot point of the lever project on an inner surface of the lever accommodation recess. Further, an entrance part of the lever accommodation recess serves as an assembling passage between front and rear cam surfaces.

The lever is a single plate with an operating portion on one end and a long narrow acting portion extending from the operating portion to the other end. Two interfering portions are provided respectively on both surfaces of the acting portion and are capable of interfering with each terminal fitting by being fit and inserted into the assembling passage. The interfering portion is a rib extending in a width direction and composed of a long interfering body linearly extending between the ends in the width direction. A cam receiving portion extends in an oblique direction from the one end of the interfering body and is capable of sliding in contact with the cam surface.

The lever is inserted into the lever accommodation recess from one side surface of the housing while pressing the operating portion. Thus, the interfering bodies of the interfering portions move along the assembling passage to guide the lever smoothly in an assembling operation. Wires may be pulled out rearward from the rear surface of the housing. However, the lever will not interfere with the wires during assembly of the lever onto the housing.

The lever of the above-described connector must be arranged laterally to the housing when assembling the lever with the housing and the lever is laterally long. Thus, the lever assembling operation is difficult if a sufficient space is not available laterally of the housing.

SUMMARY

A lever-type connector disclosed in this specification includes a housing. A lever is mounted rotatably on the housing and is rotatable between an initial position and a connection position. Wires are pulled out rearward from the housing. The lever-type connector is connectable to a mating connector by rotating the lever from the initial position to the connection position. The lever is U-shaped and has two arm plates are coupled by an operating portion. A ridge piece is provided on a facing surface of each arm plate. The housing includes a fitting that is fittable to the mating connector and a lever guide provided behind the fitting. The lever guide includes front and rear rails extending in a direction perpendicular to a pull-out direction of the wires and configured to guide the ridge piece from a first side toward a second side. The lever is assembled at the connection position when the guide piece reaches the second side. An introducing portion is open on one end of the rear rail and is configured to introduce the ridge piece between the two rails from a position behind the housing. An escaping portion is open on the other end of the rear rail and is configured to rotate the ridge piece to the position behind the housing as the lever is rotated from the connection position to the initial position.

According to this configuration, the lever is U-shaped. Thus, the ridge piece passes through the introducing portion to butt against the front rail to stop a forward movement if the lever is arranged behind the housing to go around the wires and moved forward toward the housing. Subsequently, the ridge piece is moved laterally along the front rail (from the one end toward the other end of the rail) so that the lever can be assembled at the connection position. The lever then is rotated from the connection position to the initial position so that the ridge piece is rotated to the position behind the housing through the escaping portion.

Sufficient space for the lever may not be available laterally of the housing. However, a lever assembling operation can be guided from the position behind the housing while the wires are avoided.

A lock may be provided on the facing surface of the arm plate and may be configured to hold the lever at the initial position. The lock may include a deflectable deflection piece and a lock claw provided on a tip of the deflection piece. The lock claw may move forward through the escaping portion from the position behind the housing as the ridge piece is introduced between the rails through the introducing portion from the position behind the housing. According to this configuration, the lock claw passes through the escaping portion during assembly of the lever onto the housing from behind without interfering with the rear rail. Thus, the lock claw is not deformed or scraped.

An inserting portion may be provided on an end part of the front rail and may be configured to allow the lock claw to pass therethrough. The lock claw that has moved forward through the escaping portion from the position behind the housing may further move forward through the inserting portion. According to this configuration, the lock claw that has passed through the escaping portion then passes through the introducing portion without interfering with the front rail. Thus, deformation or scraping of the lock claw is assured more positively.

Accordingly, a lever-type connector is provided so that a lever assembling operation is guided from a position behind a housing while avoiding wires.

DETAILED DESCRIPTION

Figure 1:
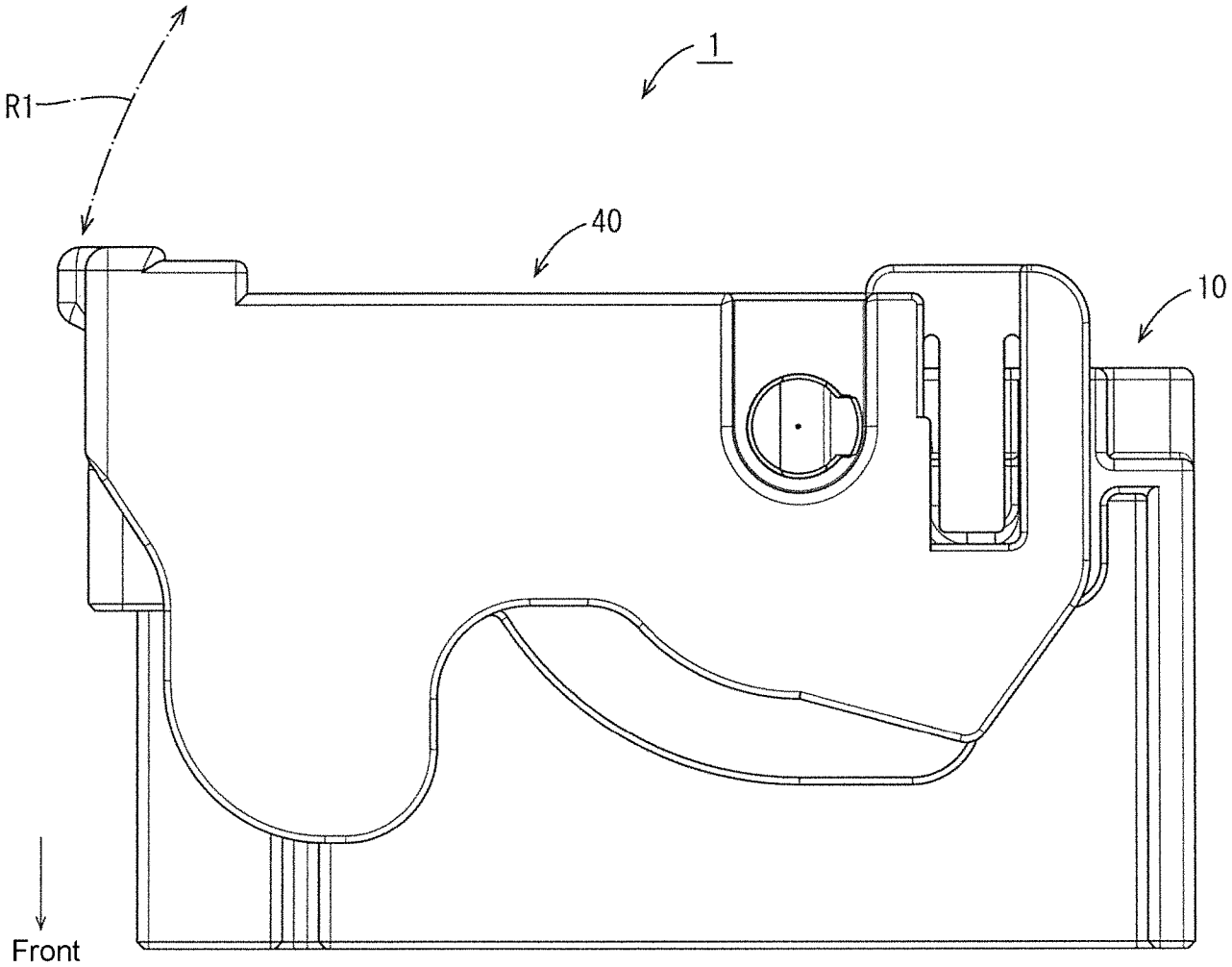
FIG. 1 is a view showing a lever-type connector according to an embodiment.

A lever-type connector 1 in accordance with an embodiment of the invention includes a housing 10 and a lever 40, as shown in FIG. 1. The lever 40 is mounted rotatably on the housing 10, and the housing 10 is connectable to and separable from an unillustrated mating connector by rotating this lever 40 in rotating directions R1. In the following description, a connection side of the housing 10 to the mating connector is referred to as a front. Further, one of plural identical members may be denoted by a reference sign and the other members may not be denoted by the reference sign.

Figure 8:
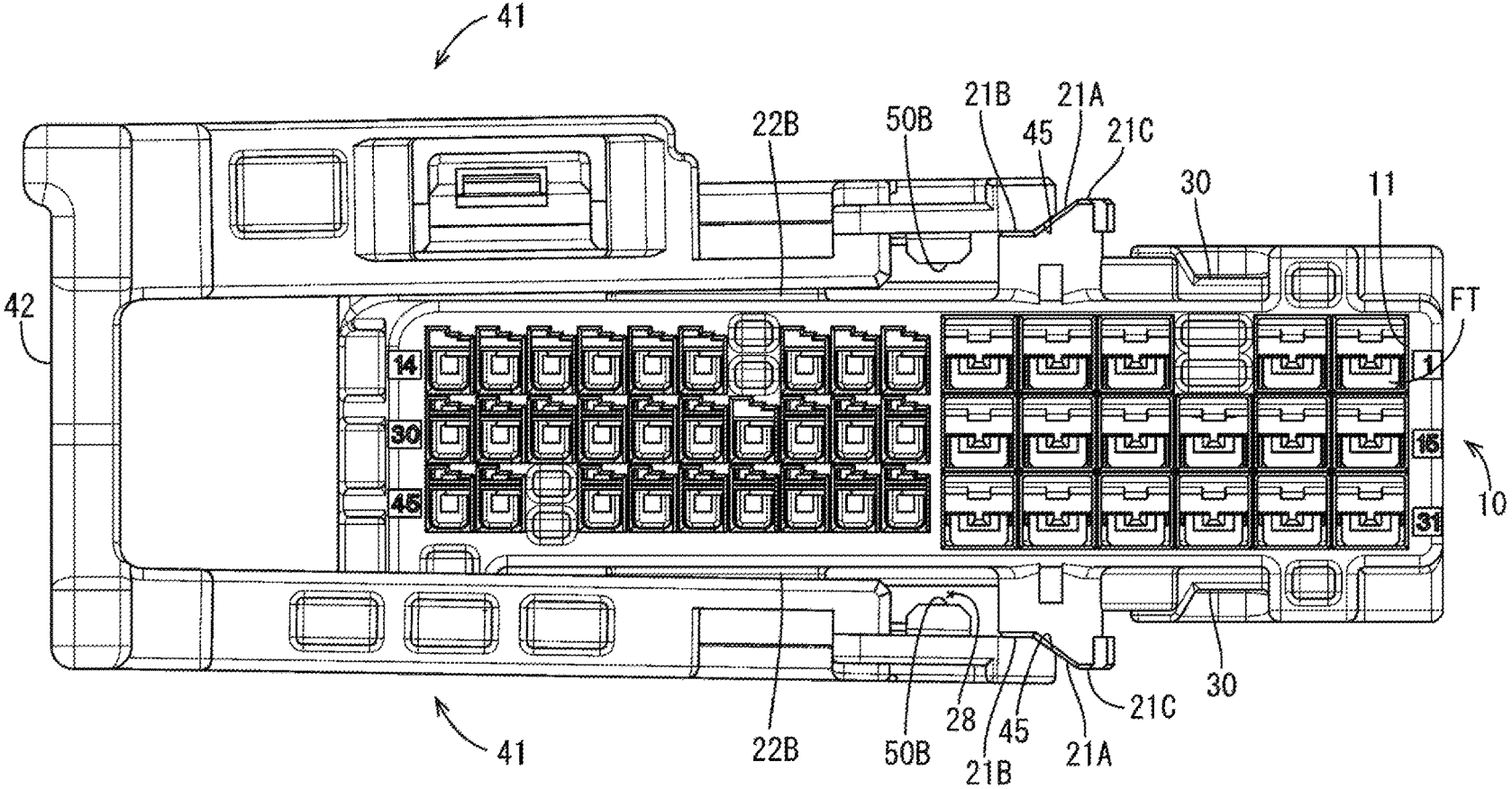
FIG. 8 is a view showing a state where the lever is at a ride initial position.
Figure 14:
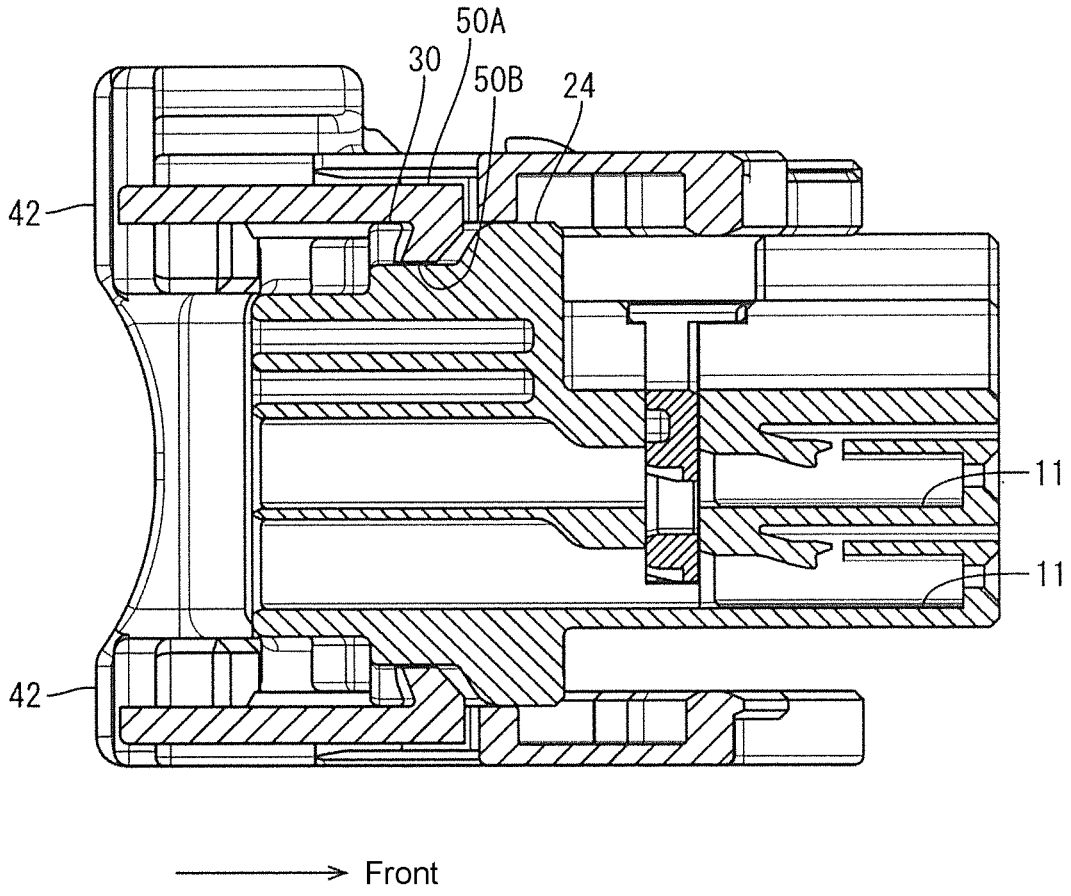
FIG. 14 is a section along B-B of FIG. 13.

The housing 10 is made of synthetic resin and is substantially in the form of a somewhat flat rectangular parallelepiped. As shown in FIG. 14, cavities 11 penetrate the housing 10 in a front-rear direction. As shown in FIG. 8, female terminals FT are accommodated inside the cavities 11 and can be fit and connected to unillustrated male terminals accommodated in the mating connector as the housing 10 and the mating connector are connected. Unillustrated wires connected to the female terminals FT extend through openings on back surface sides of the cavities 11.

Figure 2:
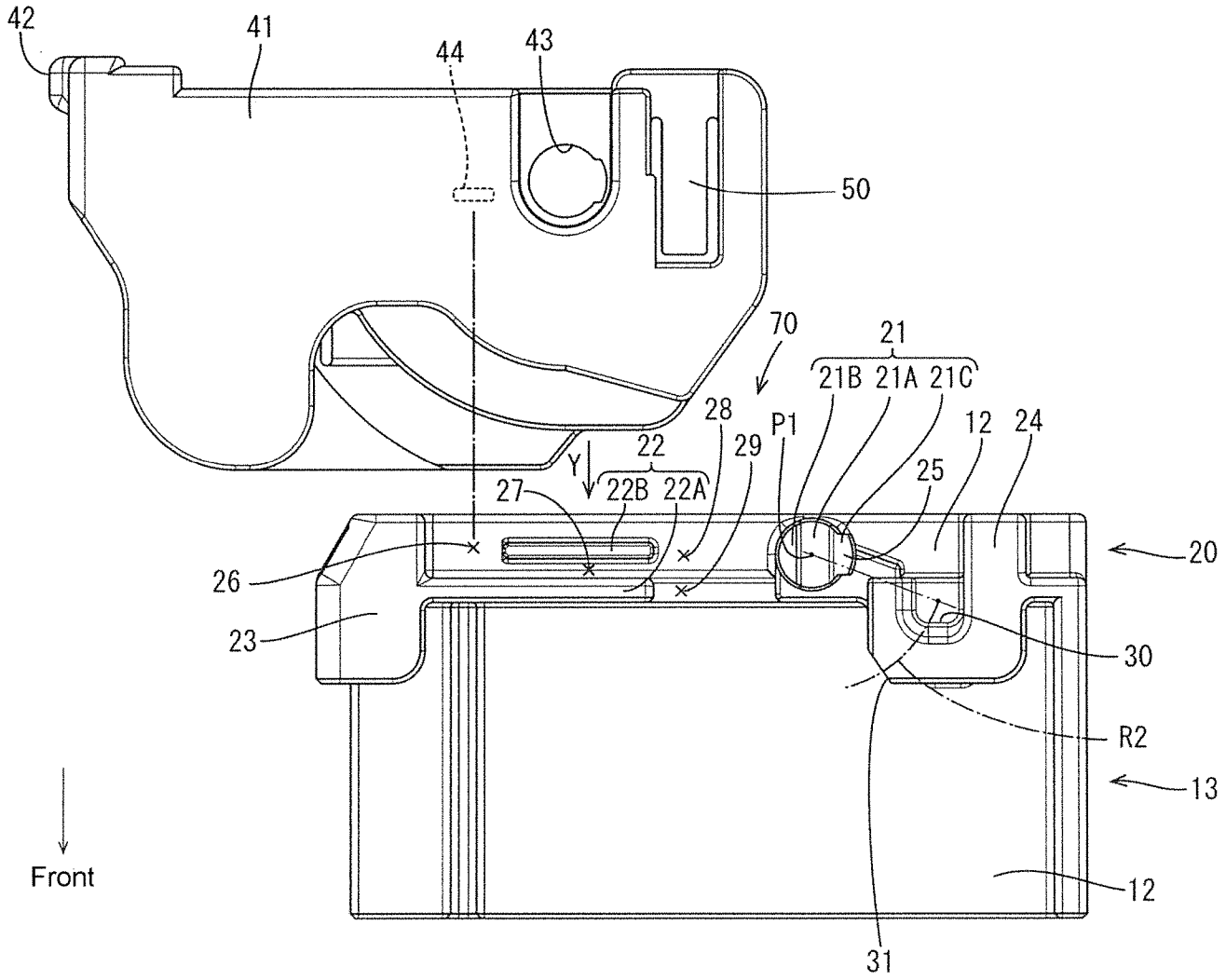
FIG. 2 is a view showing a state where a lever is disposed at a position before assembling with respect to a connector.

As shown in FIG. 2, a front of the housing 10 serves as a connector fitting portion 13 into which the mating connector is fit, and a rear serves as a lever mounting portion 20 on which the lever 40 is mounted.

The lever mounting portion 20 has two parallel outer side surfaces 12, 12. Each outer side surface 12A has projections that include a support shaft 21 for rotatably supporting the lever 40, a guide 22 for guiding the lever 40 to the support shaft 21, a closing protrusion 23 and a planar protrusion 24 for supporting the lever 40 from inside. These elements are provided on the outer side surfaces 12 at positions substantially corresponding in a front-rear direction and a lateral direction of the housing 10.

The support shaft 21 is cylindrical and projects from the outer side surface 12. A central part of a projecting end of the support shaft 21 in the lateral direction forms an inclined surface 21A inclined leftward in FIG. 2. Parts to the left and right of the inclined surface 21A respectively serve as a first flat surface 21B and a second flat surface 21C parallel to the outer side surface 12. A holding protrusion 25 protrudes on a right part of the support shaft 21 for preventing the lever 40 from coming off the support shaft 21. A projecting end of the holding protrusion 25 is a flat surface coplanar with the second flat surface 21C.

The guide 22 (an example of front and rear rails) is provided between a left end of the lever mounting portion 20 and the support shaft 21. The guide 22 includes a front rail 22A disposed along a front end of the lever mounting portion 20 and a rear rail 22B disposed behind the front rail 22A and parallel to the front rail 22A. The rear rail 22B is shorter than the front rail 22A. Right ends of the front and rear rail 22A, 22B are at the same position in the lateral direction. A space between the front and rear rails 22A, 22B serves as a lateral guiding path 27 for displacing a ridge piece 44 of an arm plate 41 to be described later in the lateral direction. A right end of the rear rail 22B is open to form a clearance between the right end of the rear rail 22B and the support shaft 21. This clearance serves as an escaping portion 28 for allowing the ridge piece 44 of the arm plate 41 to escape rearward. Further, a right end side of the front rail 22A is open to form a clearance between the right end of the front rail 22A and the support shaft 21. This clearance serves as an inserting portion 29 for allowing the ridge piece 44 of the arm plate 41 to escape rearward.

The closing protrusion 23 is provided side by side with the guide 22 on a left end of the lever mounting portion 20. A right end of the closing protrusion 23 is straight. Note that a left end side of the rear rail 22B is open to form a clearance between the left end of the rear rail 22B and the closing protrusion 23. This clearance serves as an introducing portion 26 into which the ridge piece 44 of the arm plate 41 is inserted. A substantially center of the closing protrusion 23 is connected to the front rail 22A. Specifically, the introducing portion 26 has left and front sides closed by the closing protrusion 23 and the front rail 22A.

The planar protrusion 24 is disposed to the right of the support shaft 21. The planar protrusion 24 is formed into a J shape by protruding from a rear end of the lever mounting portion 20 to the connector fitting portion 13 and being largely curved toward the vicinity of the projecting end of the support shaft 21. A projecting end of the planar protrusion 24 is formed into a flat surface. A curved inner surface of the planar protrusion 24 is sloped to be wider toward a bottom surface (region of the outer side surface 12 enclosed by the curved inner surface) and serves as a side wall of a locking accommodation recess 30.

Figure 18:
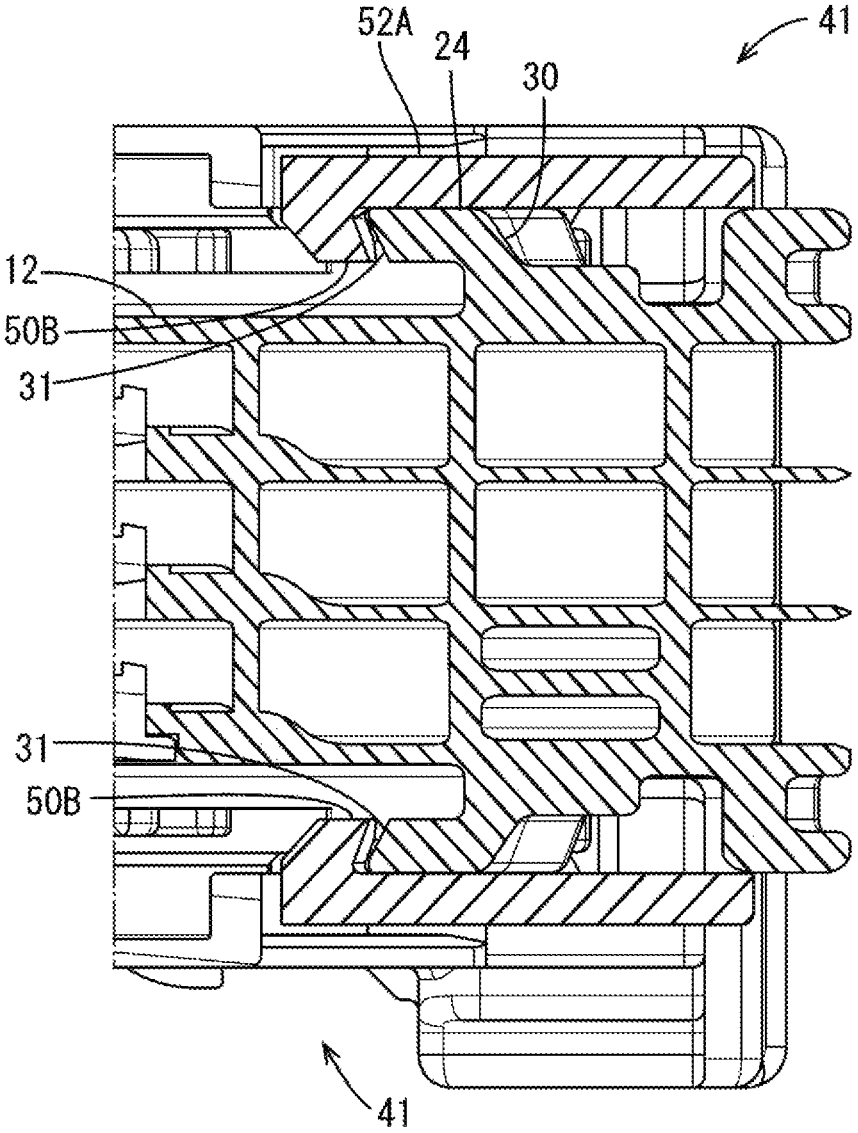
FIG. 18 is a section along C-C of FIG. 15.

A curved outer side surface of the planar protrusion 24 is formed with a lock receiving portion 31 to be locked by a lock claw 50B of the lever 40 to be described later. As shown in FIG. 18, the lock receiving portion 31 is a flat surface overhanging with respect to the outer side surface 12. The lock receiving portion 31 is perpendicular to a rotation locus R2 passing through a center of the bottom surface of the locking accommodation recess 30 with an axis center P1 of the support shaft 21 as a center as shown in FIG. 2.

Figure 3:
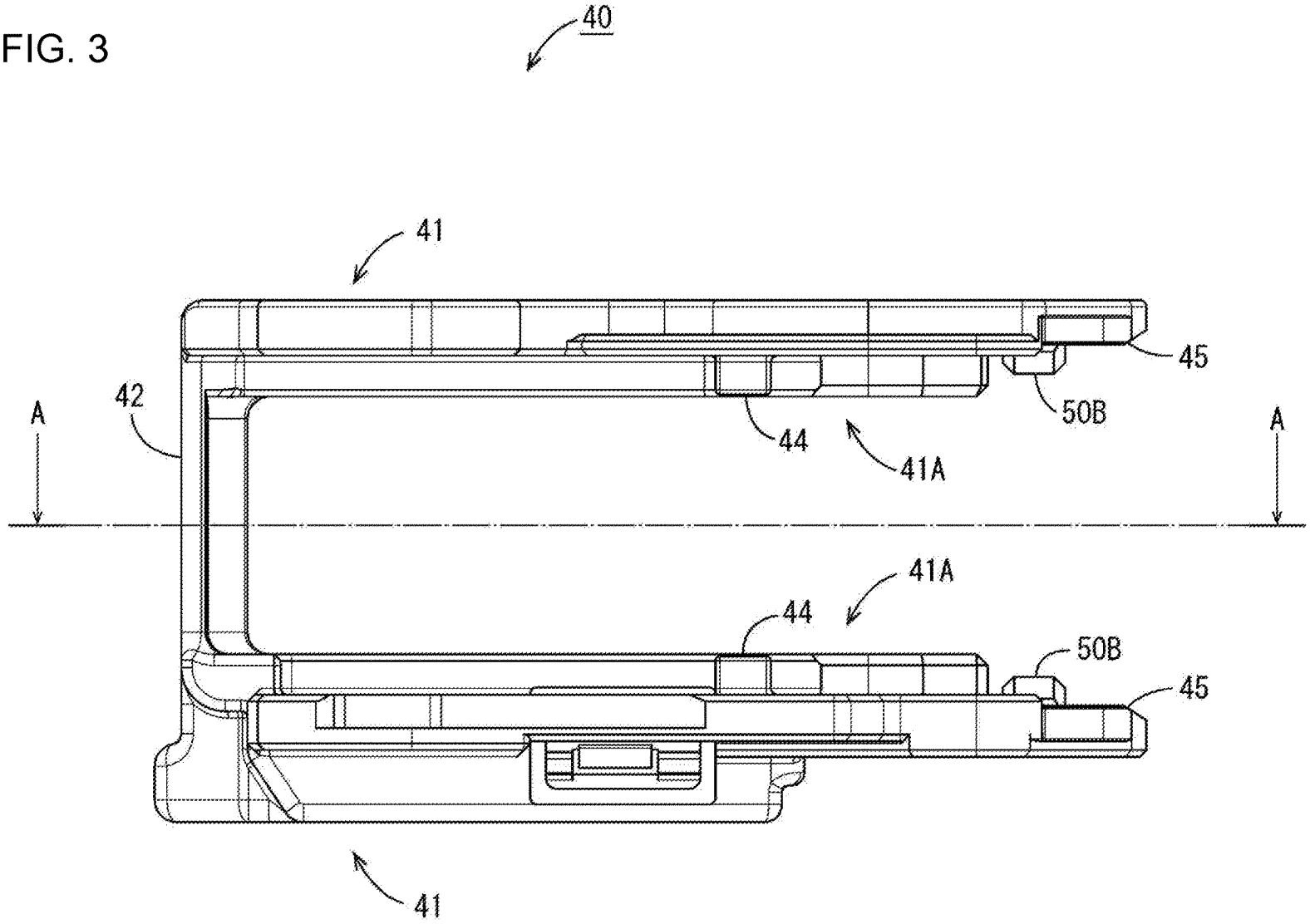
FIG. 3 is a front view of the lever.

As shown in FIGS. 2 and 3, the lever 40 includes two arm plates 41 and an operating portion 42 coupling the arm plates 41 to define a substantially U-shape. The arm plates 41 are disposed respectively along the outer side surfaces 12 of the lever mounting portion 20.

Figure 4:
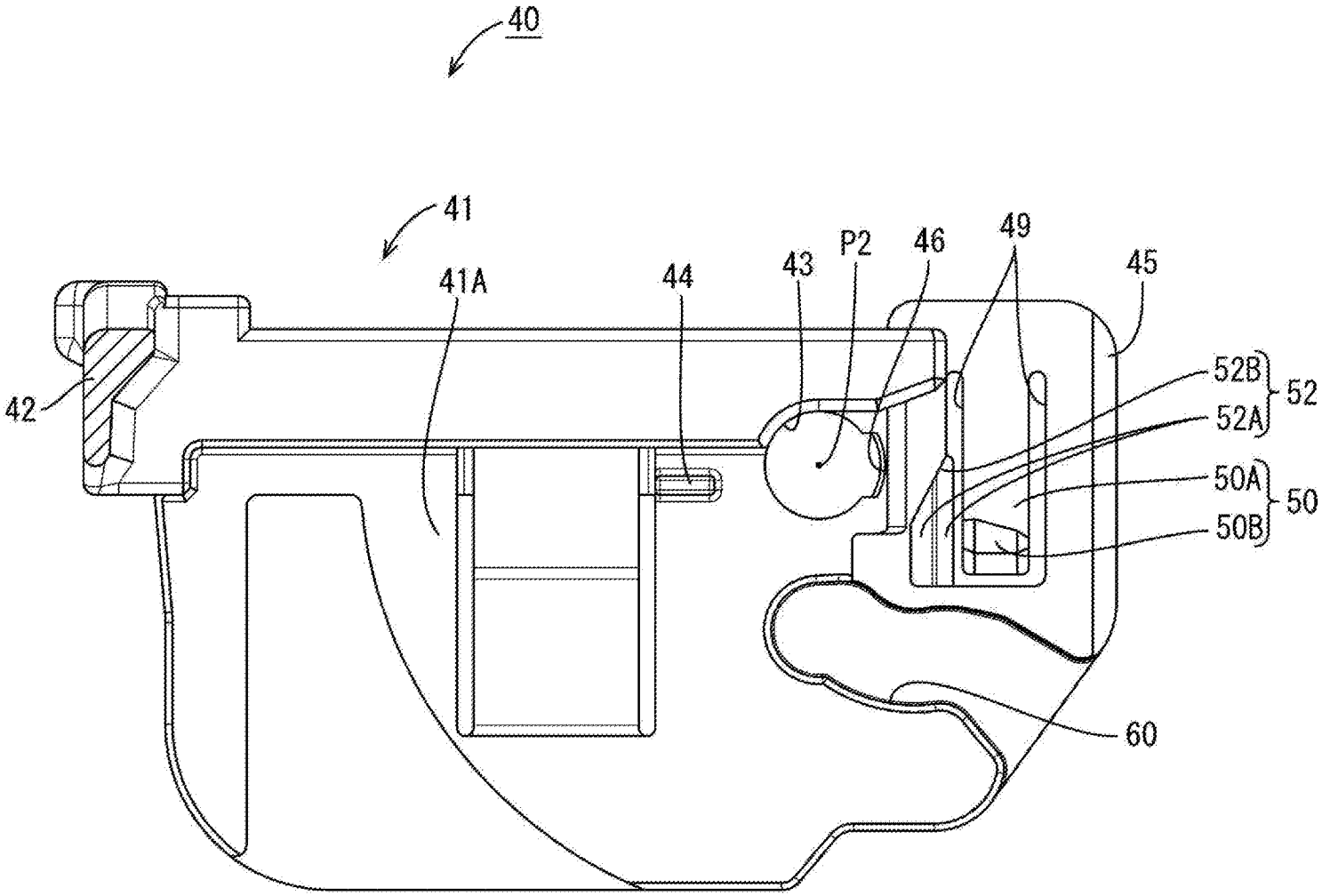
FIG. 4 is a view showing a facing surface of the lever (section along A-A of FIG. 3).
Figure 5:
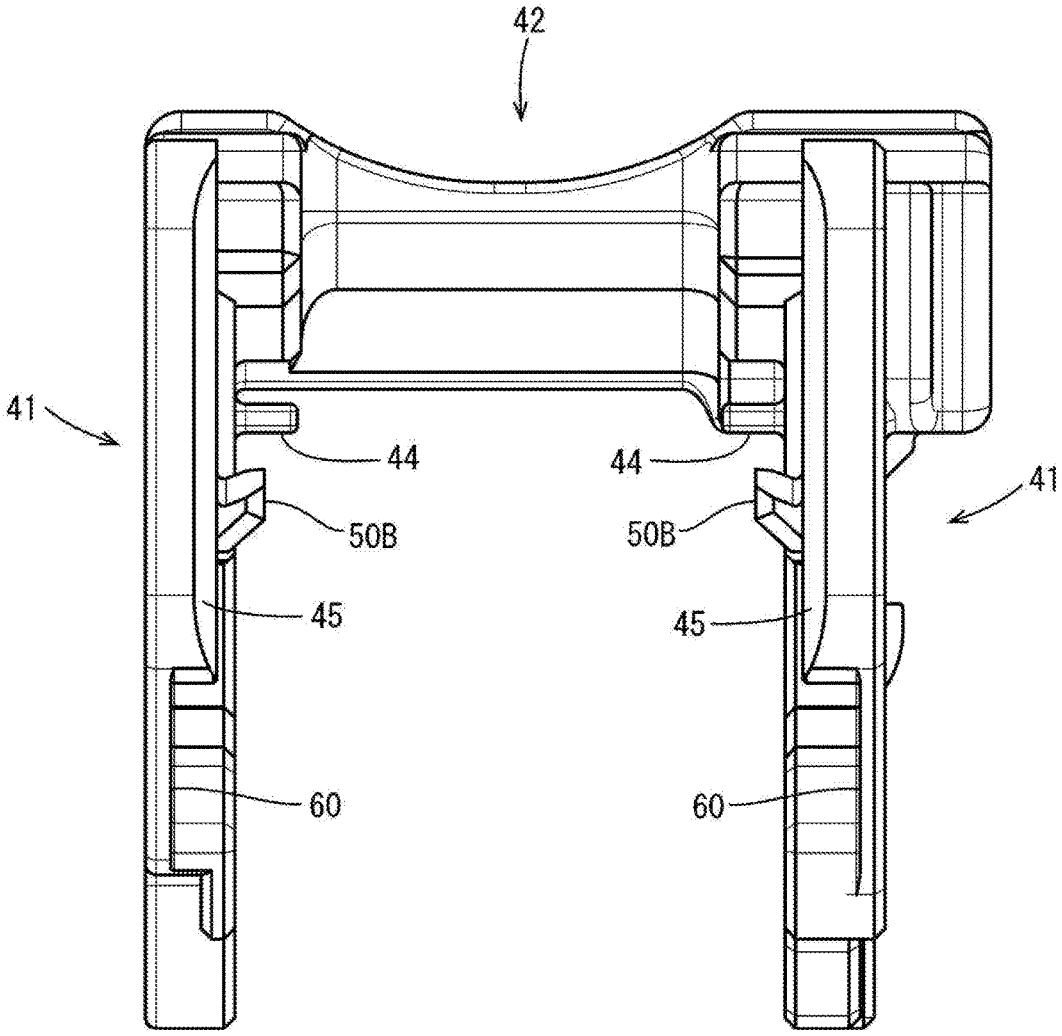
FIG. 5 is a side view of the lever.
Figure 6:
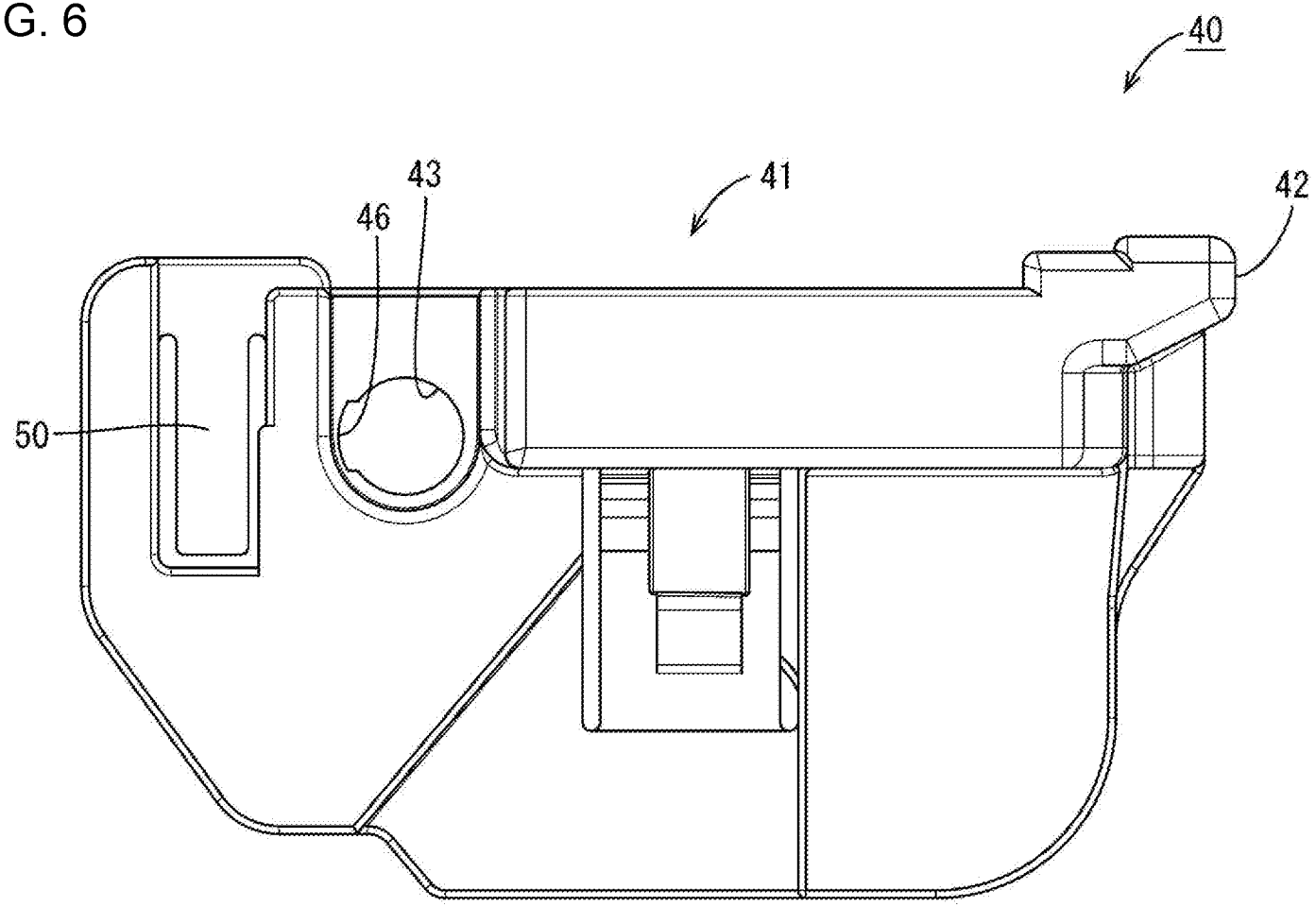
FIG. 6 is a view showing one outer surface of the lever.

As shown in FIG. 4, each of facing surfaces 41A of the arm plates 41 facing each other is provided with a shaft hole 43, the ridge piece 44 (an example of a guided portion), an inclined receiving surface 45, a lock 50 and a lock cover 52.

As shown in FIG. 4, the shaft hole 43 penetrates through the arm plate 41 in a plate thickness direction and is circular. A mounting groove 46 shaped to correspond to the holding protrusion 25 of the support shaft 21 is formed on an opening edge of the shaft hole 43 on a side distant from the operating portion 42.

The ridge piece 44 is in the form of a laterally extending ridge and is provided between the operating portion 42 and the shaft hole 43.

The inclined receiving surface 45 is a tapered surface on a right end of the facing surface 41A in FIG. 4 and is inclined out toward a right edge (i.e. inclined toward the operating portion 42).

In FIG. 4, a substantially U-shaped slit 49 is formed to the right of the shaft hole 43. An upper end of the slit 49 in FIG. 4 has a semicircular shape having a diameter equal to a lateral width of the slit 49.

The lock 50 is in the form of a tongue separated from the other part by the slit 49. The lock 50 includes a deflection piece 50A having a base end on an upper side shown in FIG. 14 and the lock claw 50B provided on a free end of the deflection piece 50A. The deflection piece 50A is deflectable and displaceable in a direction perpendicular to the rotating directions R1 of the lever 40. As shown in FIG. 18, the lock claw 50B projects toward the other arm plate 41 in an overhanging manner in the direction perpendicular to the rotating directions R1 of the lever 40.

Figure 19:
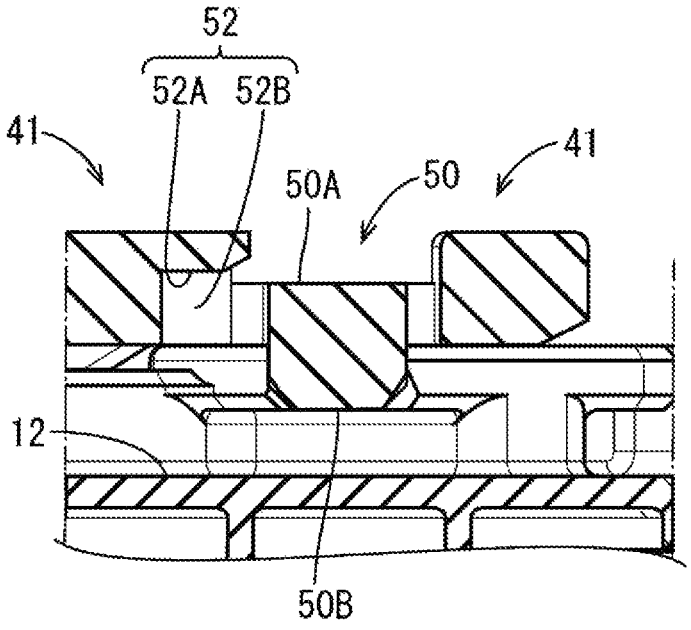
FIG. 19 is a section along D-D of FIG. 15.

Note that the arm plate 41 projects and recedes at the slit 49 as a boundary. In this way, the deflection piece 50A is located entirely located inward (down in FIG. 19) of the outer surface of the arm plate 41 in a state where the deflection piece 50A is neither deflected nor displaced, as shown in FIG. 19.

The lock cover 52 is adjacent to the lock 50. The lock cover 52 is provided with an edge of the slit 49 closer to the operating portion 42 when viewed from the lock 50 as one end and formed by recessing the facing surface 41A of the arm plate 41 while leaving an outer surface. The lock cover 52 includes a ceiling 52A facing the outer side surface 12 of the housing 10 and a side wall 52B perpendicular to the ceiling 52A and disposed along a direction from a left back of the lock cover 52 of FIG. 4 toward a base end of the lock 50. The ceiling 52A is sloped to become gradually thicker from the left edge of the slit 49 toward the left back of the lock cover 52.

The arm plate 41 has a cam groove 60 into which a cam pin of the mating connector is fit. The cam groove 60 is a recess disposed to approach the shaft hole 43 from a right-lower corner part of the arm plate 41 and is thinner than other parts.

Figure 7:
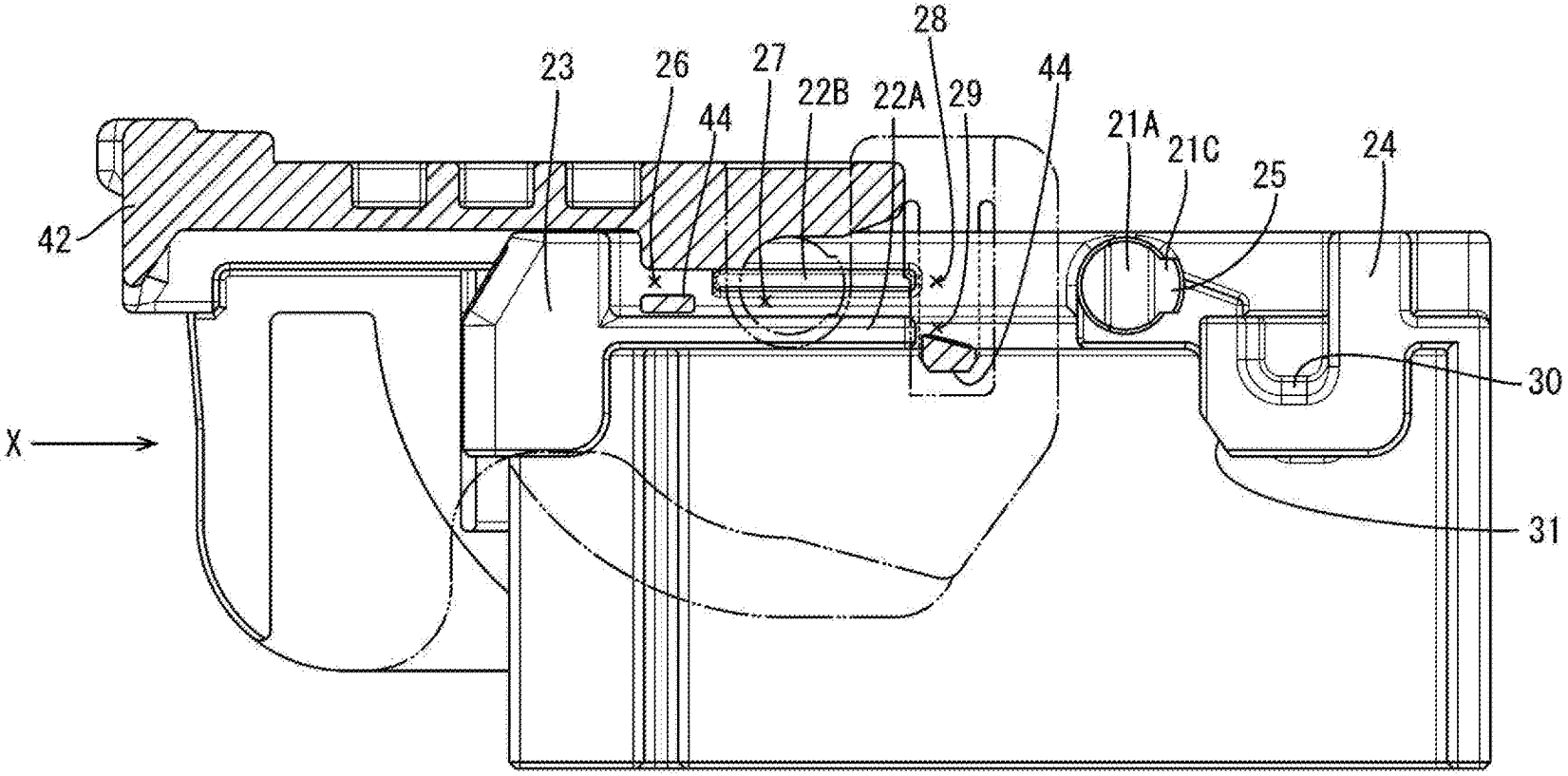
FIG. 7 is a view showing a state where the lever is arranged at an assemble initial position.

To assemble the lever 40 with the housing 10, the lever 40 is arranged behind the housing 10 from a lateral side to position the ridge pieces 44 of the arm plates 41 behind the introducing portions 26 of the housing 10, as shown in FIG. 2, while the wires extending rearward from the housing 10 are disposed between the arm plates 41, 41. The entire lever 40 then is moved forward (direction indicated by an arrow Y in FIG. 2). Thus, as shown in FIG. 7, the ridge pieces 44 pass through the introducing portions 26 and butt against the front rails 22A to have further forward displacement restricted and are arranged to the left of the lateral guiding paths 27. The lock claws 50B of the lock portions 50 pass through the escaping portions 28 and the inserting portions 29 and are arranged forward of the inserting portions 29 to have leftward displacements restricted. This position is referred to as an assemble initial position.

The operating portion 42 of the lever 40 then is pushed toward the housing 10 (i.e. in a direction indicated by an arrow X in FIG. 7). The ridge pieces 44 then are displaced rightward to enter the lateral guiding paths 27 and move rightward in the lateral guiding paths 27 while being guided by the front and rear rails 22A, 22B. Specifically, the lever 40 is guided perpendicular to an extending direction of the wires with an arrangement direction of the operating portion 42 and the ridge pieces 44 aligned with the direction perpendicular to the extending direction of the wires.

Figure 9:
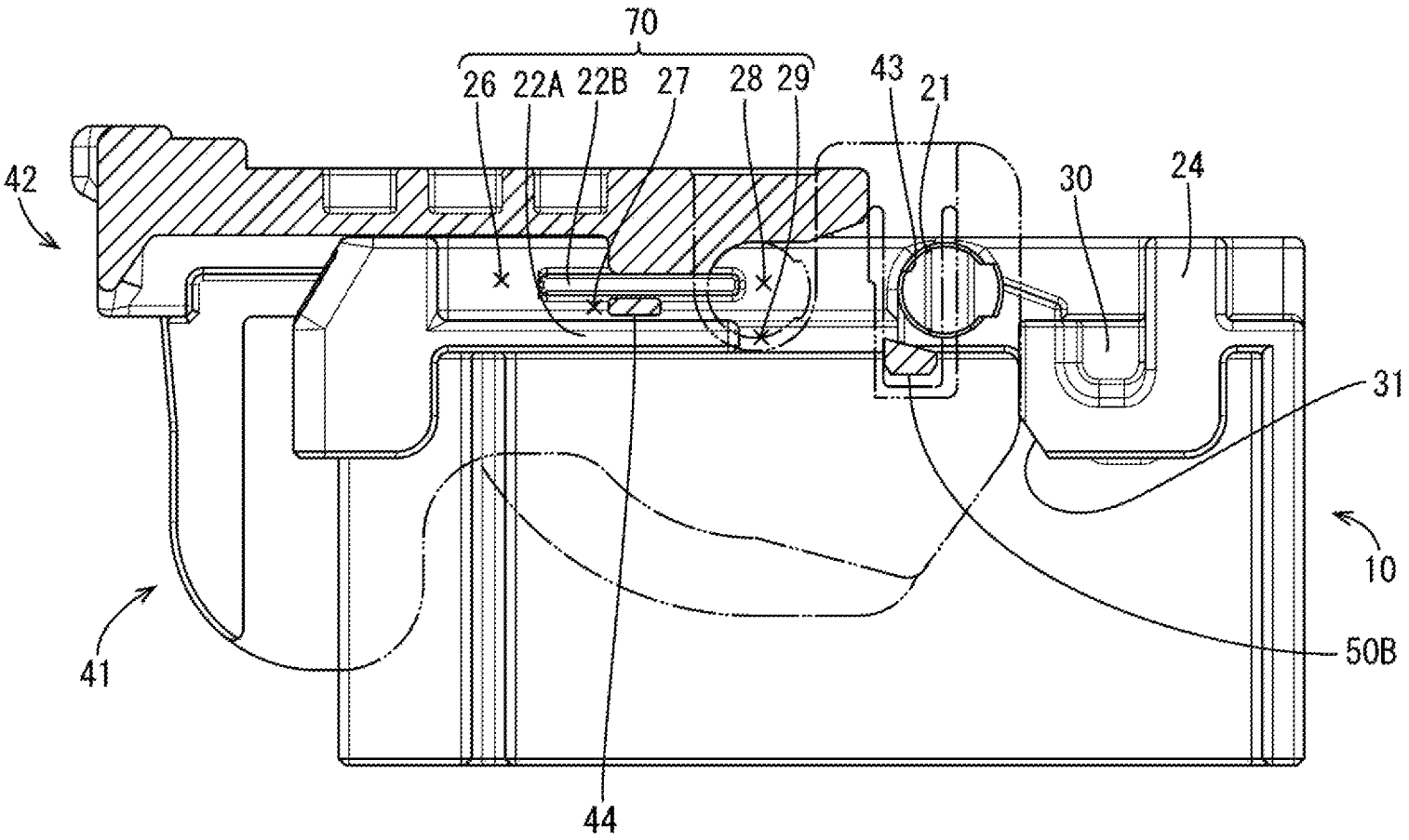
FIG. 9 is a view showing a state where the lever is passing through a lateral guiding path.

Then, as shown in FIGS. 8 and 9, the inclined receiving surfaces 45 reach the inclined surfaces 21A of the support shafts 21 and are held in surface contact therewith. This position is referred to as a ride initial position. Specifically, the lever 40 is guided from the assemble initial position to the ride initial position by the guides 22.

Figure 10:
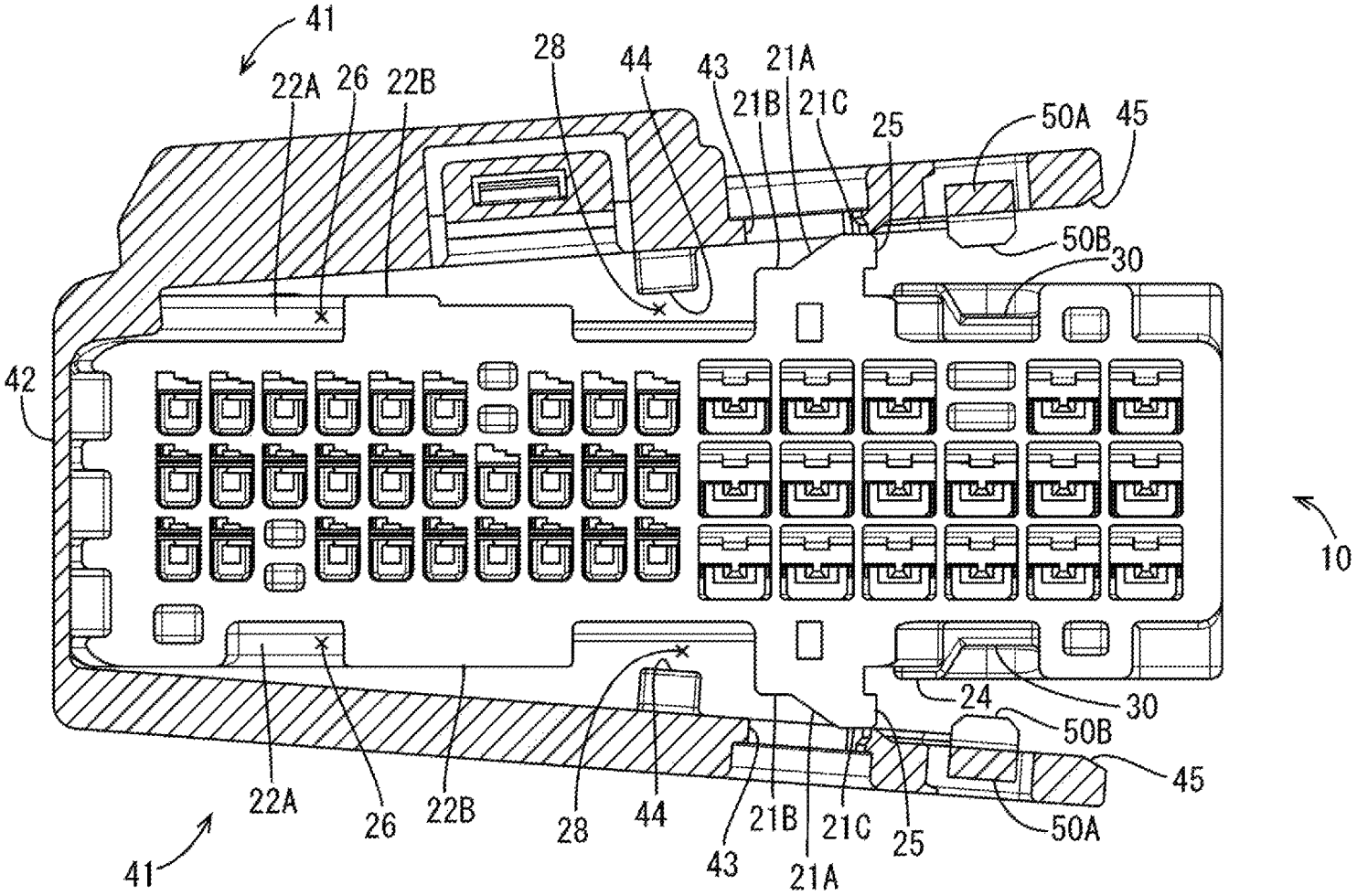
FIG. 10 is a section showing a state where the lever is riding.

Then, the lever 40 is displaced farther rightward from the ride initial position by inertia and starts riding on the support shafts 21. Note that if stress in riding on the support shafts 21 is large and the lever 40 cannot ride on the support shafts 21 only by inertia at this time, the operating portion 42 may be pushed laterally (direction indicated by the arrow Y in FIG. 2). Then, as shown in FIG. 10, the lever 40 rides on the support shafts 21 and gradually is deformed resiliently while the facing surfaces 41A of the arm plates 41 are sliding in contact with the support shafts 21 and moving rightward. Thus, the lever 40 is opened in the front-rear direction while the ridges 44 gradually exit from the guiding paths 27. At this time, the locks 50 gradually separate from the outer side surfaces 12 of the housing 10 and move rightward without contacting the planar protrusions 24.

Figure 11:
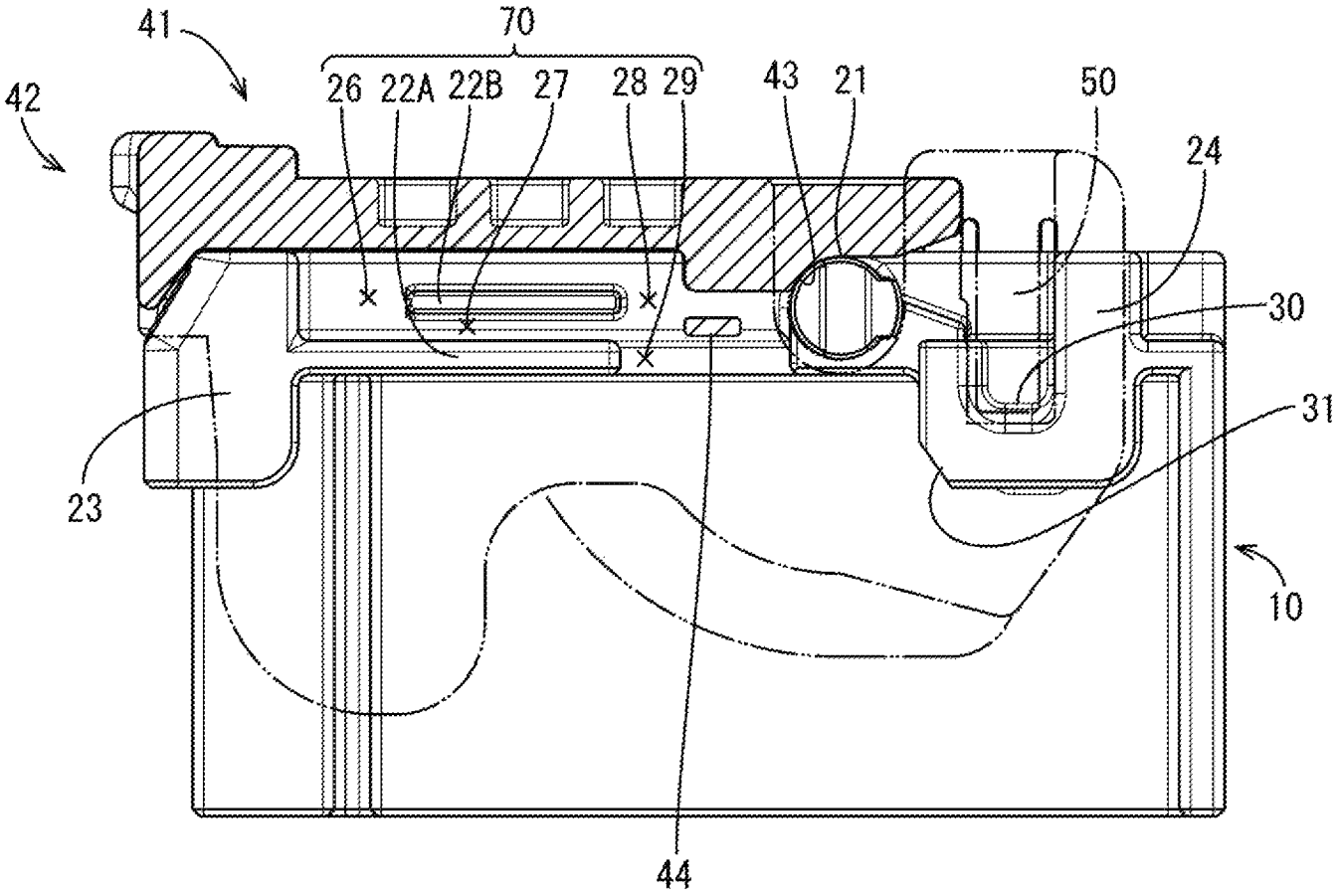
FIG. 11 is a view showing a state where the lever is arranged at an assemble end position.
Figure 12:
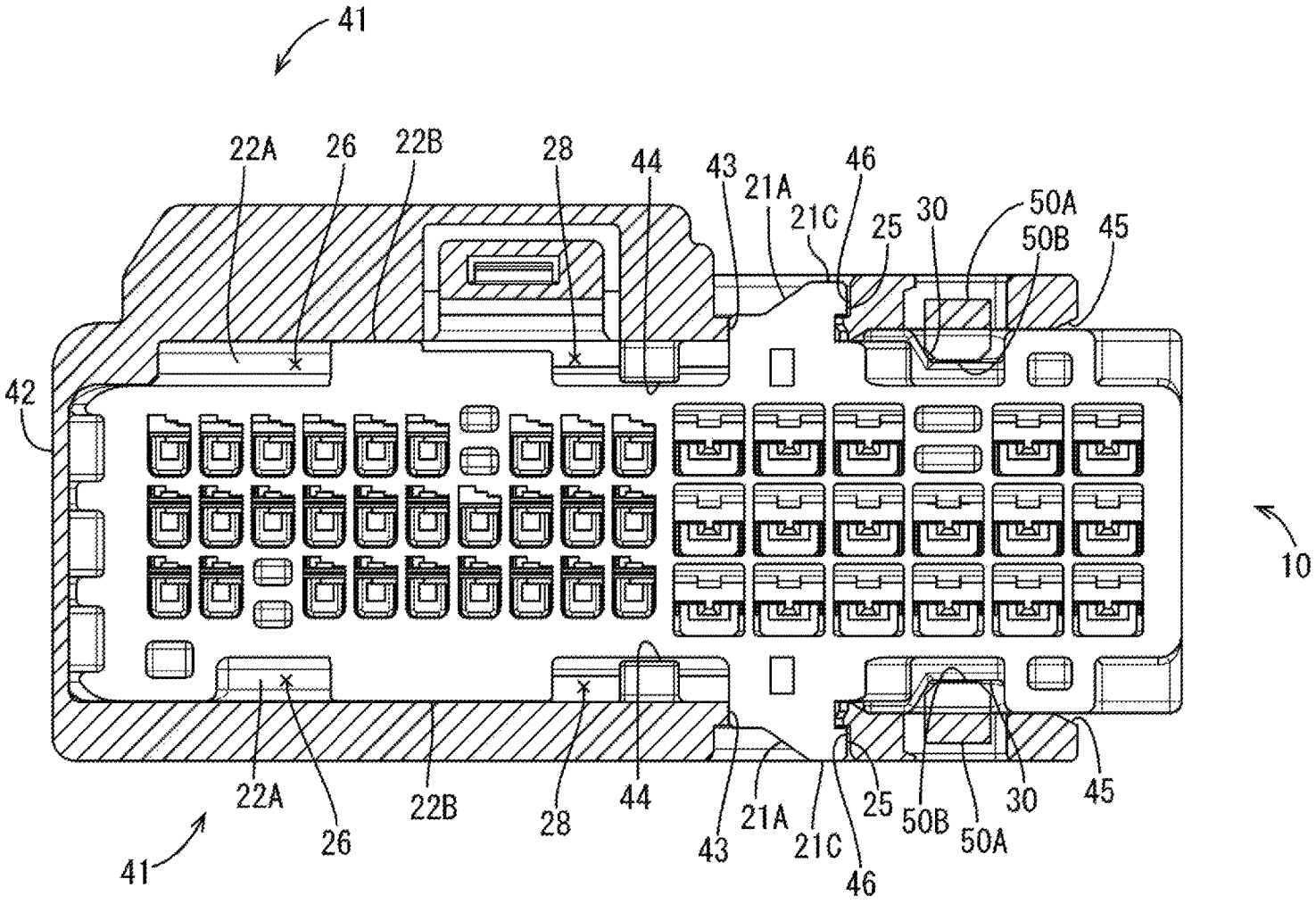
FIG. 12 is a section showing the state where the lever is arranged at the assemble end position.
Figure 13:
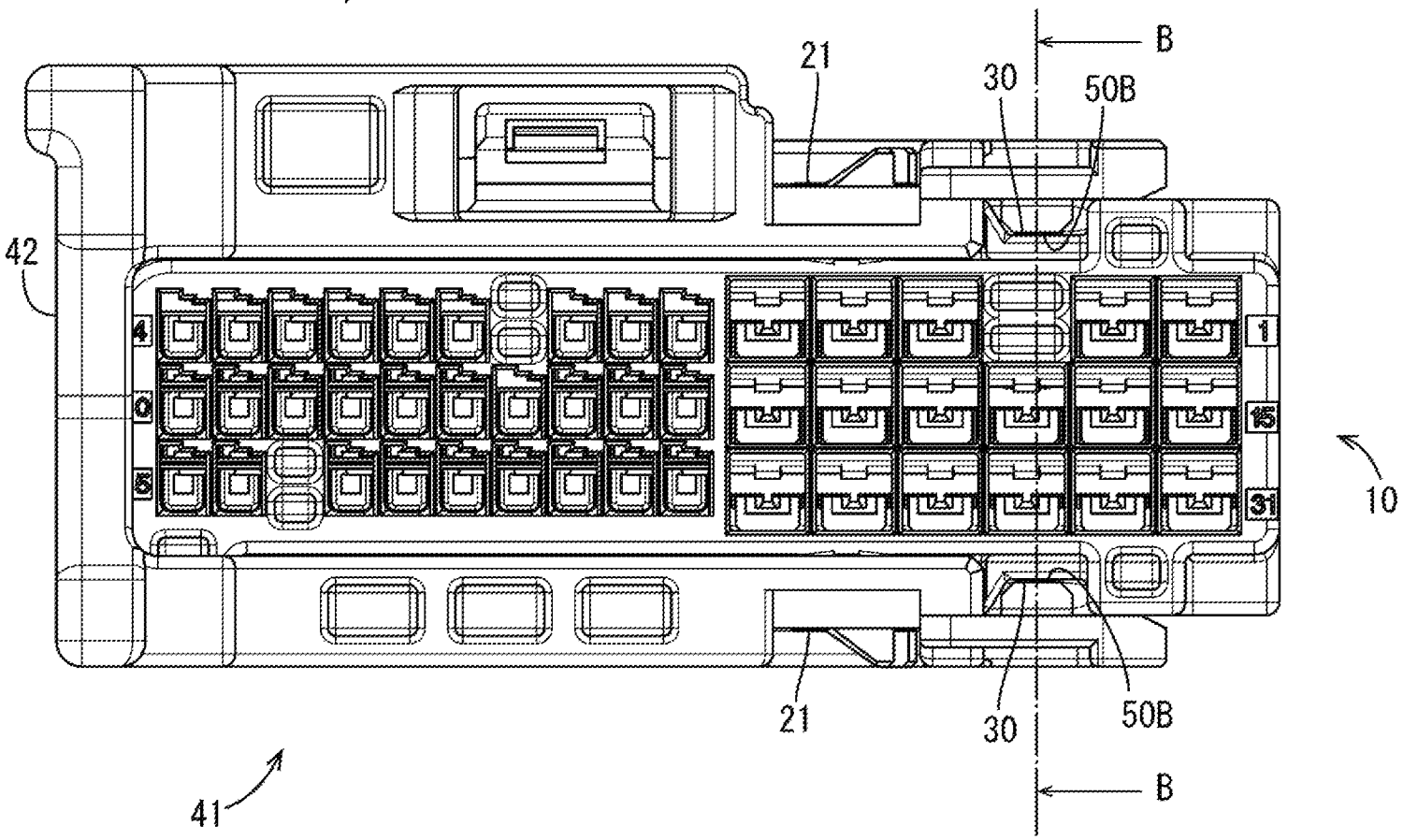
FIG. 13 is a back view of FIG. 12.

When the shaft holes 43 eventually reach the support shafts 21, the arm plates 41 resiliently return toward each other and the shaft holes 43 are fit externally to the support shafts 21, as shown in FIGS. 11 and 12, and the lock claws 50B of the locks 50 are fit into the locking accommodation recesses 30 of the housing 10 to restrict a rightward displacement, as shown in FIGS. 12 to 15. Thus, the assembling of the lever 40 with the housing 10 is completed. This position is referred to as an assemble end position. At this time, the ridge pieces 44 are arranged to the right of the lateral guiding paths 27 (forward of the escaping portions 28).

Figure 15:
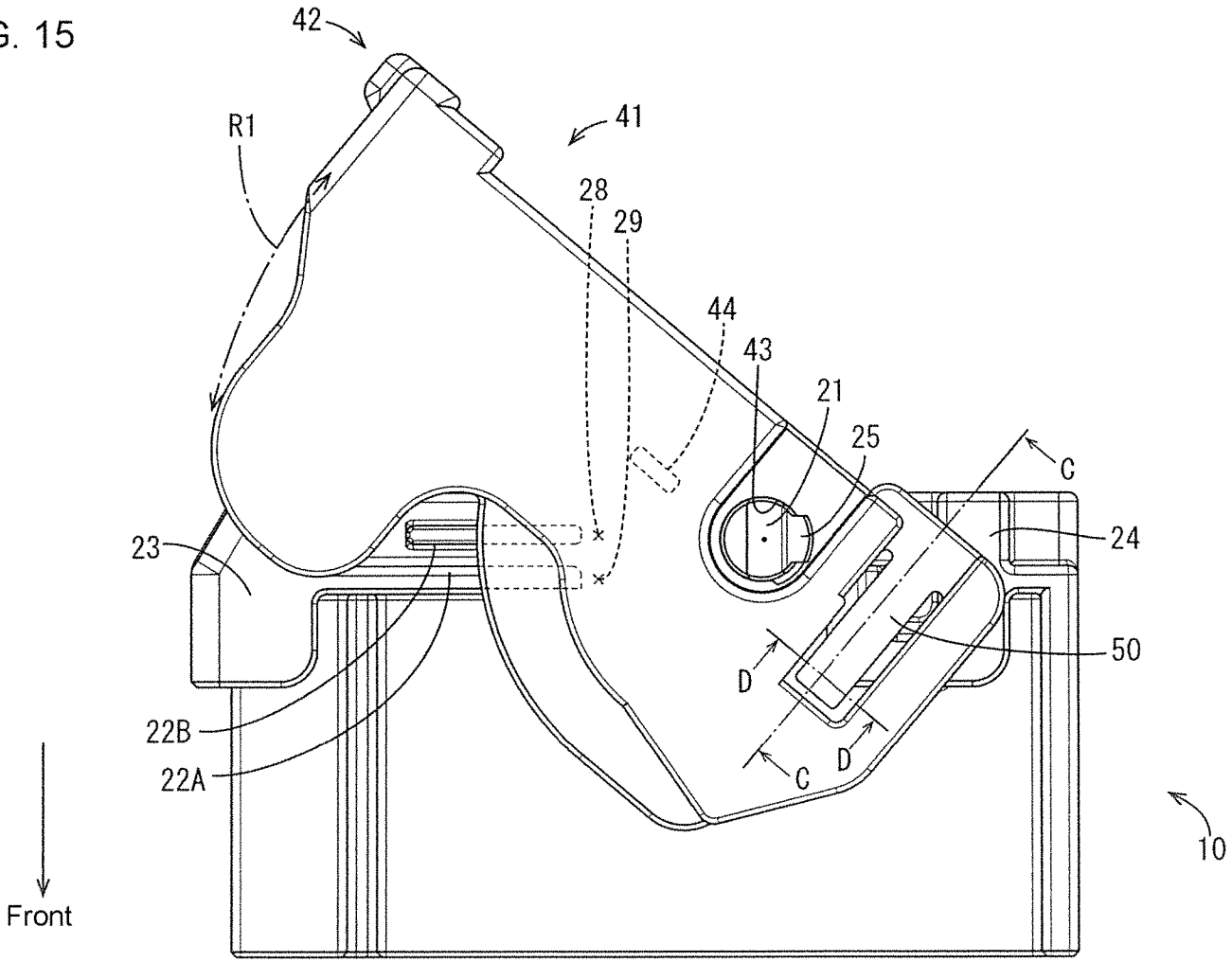
FIG. 15 is a view showing a state where the lever is arranged at a connection initial position.
Figure 16:
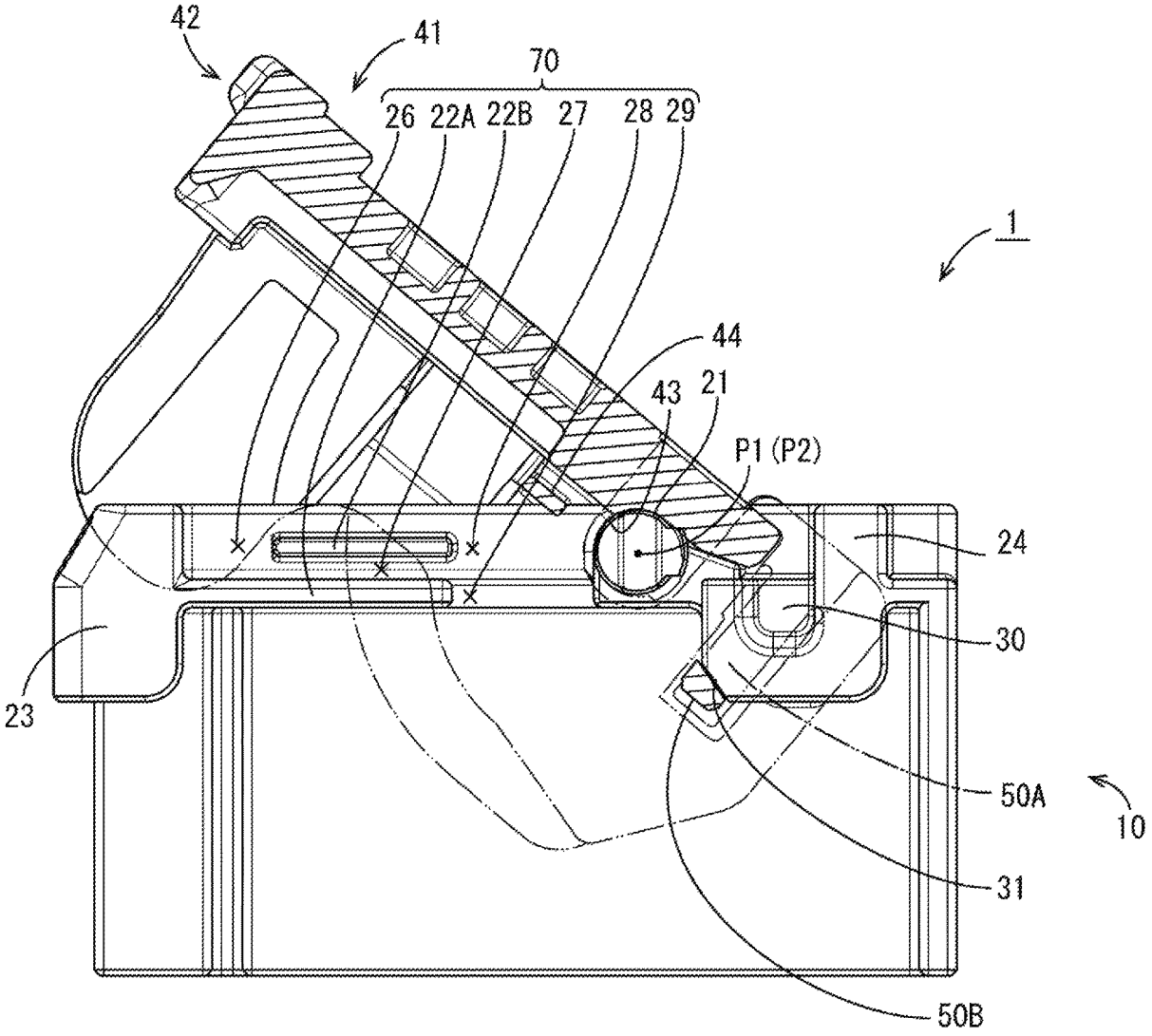
FIG. 16 is a view showing the state where the lever is arranged at the connection initial position.
Figure 17:
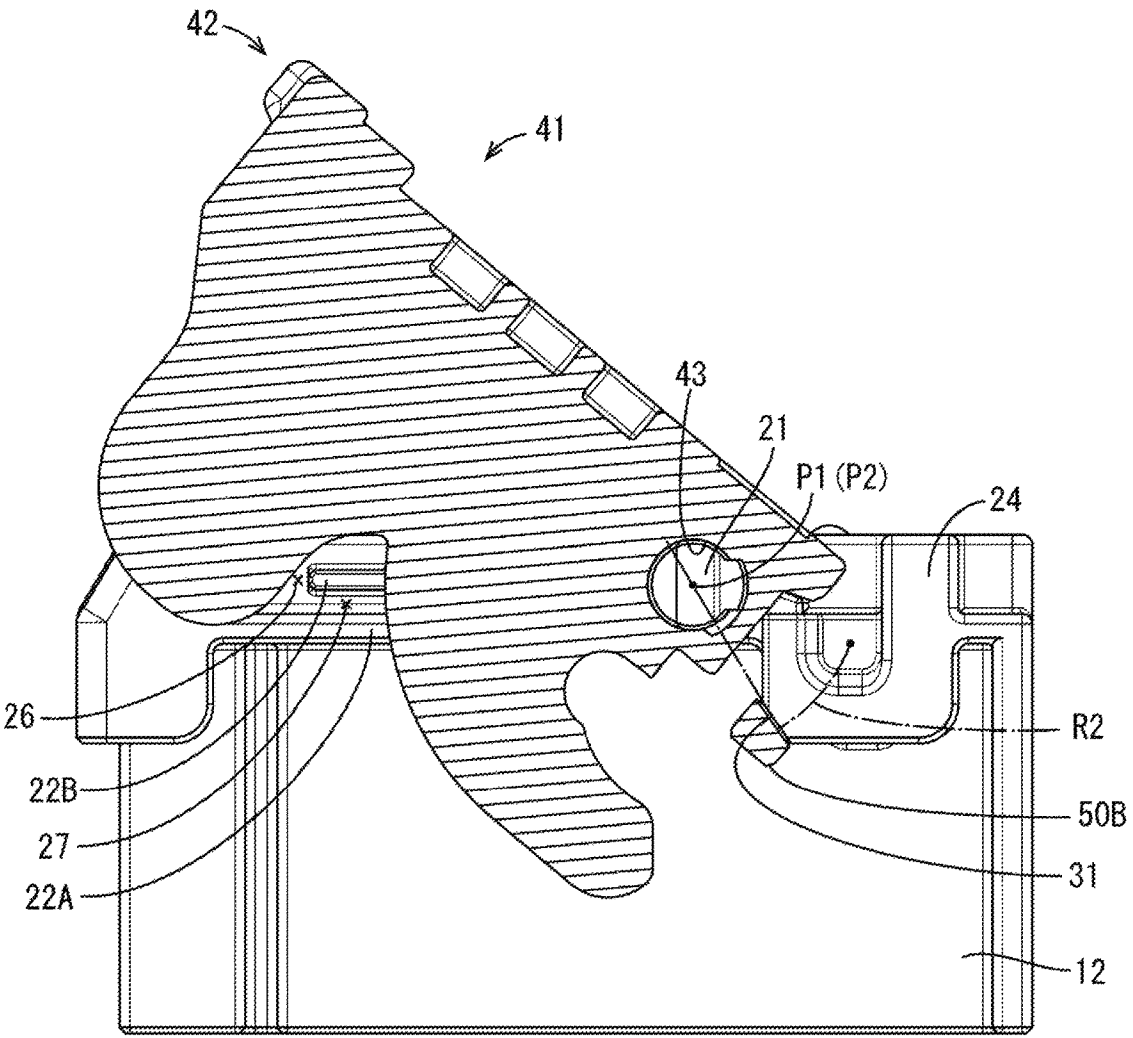
FIG. 17 is a view showing the state where the lever is arranged at the connection initial position.

In connecting the mating connector, the lever 40 is rotated rearward about the support shafts 21 from the assemble end position. Then, as shown in FIGS. 15 to 17, the holding protrusions 25 of the support shafts 21 lock the shaft holes 43 in an axial direction and the lever 40 is rotated with the opening thereof prevented. Further, according to the rotation, the ridge pieces 44 of the lever 40 exit rearward from the escaping portions 28 and the lock claws 50B of the locks 50 move along the rotation locus R2 shown in FIG. 17 to ride resiliently on the planar protrusions 24.

Eventually, the locks 50 move over the planar protrusions 24 to return resiliently and, as shown in FIGS. 18 and 19, return to the state where the locks 50 are disposed inward (toward the housing 10) of the outer surfaces of the arm plates 41 and the lock claws 50B face the lock receiving portions 31. This position is referred to as a connection initial position.

As just described, the introducing portion 26, the guide portion 22, the lateral guiding path 27 and the escaping portion 28 constitute a lever guide 70 for guiding the lever 40 from a position behind the housing 10 to the assemble end position with respect to the housing 10.

With the lever 40 at the connection initial position, the mating connector is fit into the connector fitting portion 13 from the front. Then, the mating connector enters spaces between the outer side surfaces 12 of the housing 10 and the lock claws 50B, thereby pushing the lock claws 50B to positions where the lock claws 50B do not face the lock receiving portions 31. In this way, locking between the lock claws 50B and the lock receiving portions 31 is released to enable the rotation of the lever 40.

When the lever 40 is rotated forward (i.e. toward the assemble end position), the ridge pieces 44 move forward and pass through the escaping portions 28 and the lock claws 50B move along the rotation locus R2 and move toward the locking accommodation recesses 30 while riding on the planar protrusions 24. Along with this, the cam grooves 60 pull the cam pins of the mating connector toward the support shafts 21. Then, the lever 40 returns to the assemble end position and the lock claws 50B return to the inside of the locking accommodation recesses 30 to complete the connection of the housing 10 and the mating connector, while the lever 40 is disposed at the same position as the assemble end position. This is referred to as a connection position, and the ridge pieces 44 are located forward of the escaping portions 28.

Note that if it is attempted to rotate the lever 40 toward the assemble end position without the mating connector being fit externally after the lever 40 is disposed at the connection initial position, the lock claws 50B lock the lock receiving portions 31 disposed to be perpendicular to the rotation locus R2. Thus, the lever 40 enters a rotation restricted state where any further rotation is restricted. Specifically, the lever 40 is held at the connection initial position by the locks 50.

Figure 20:
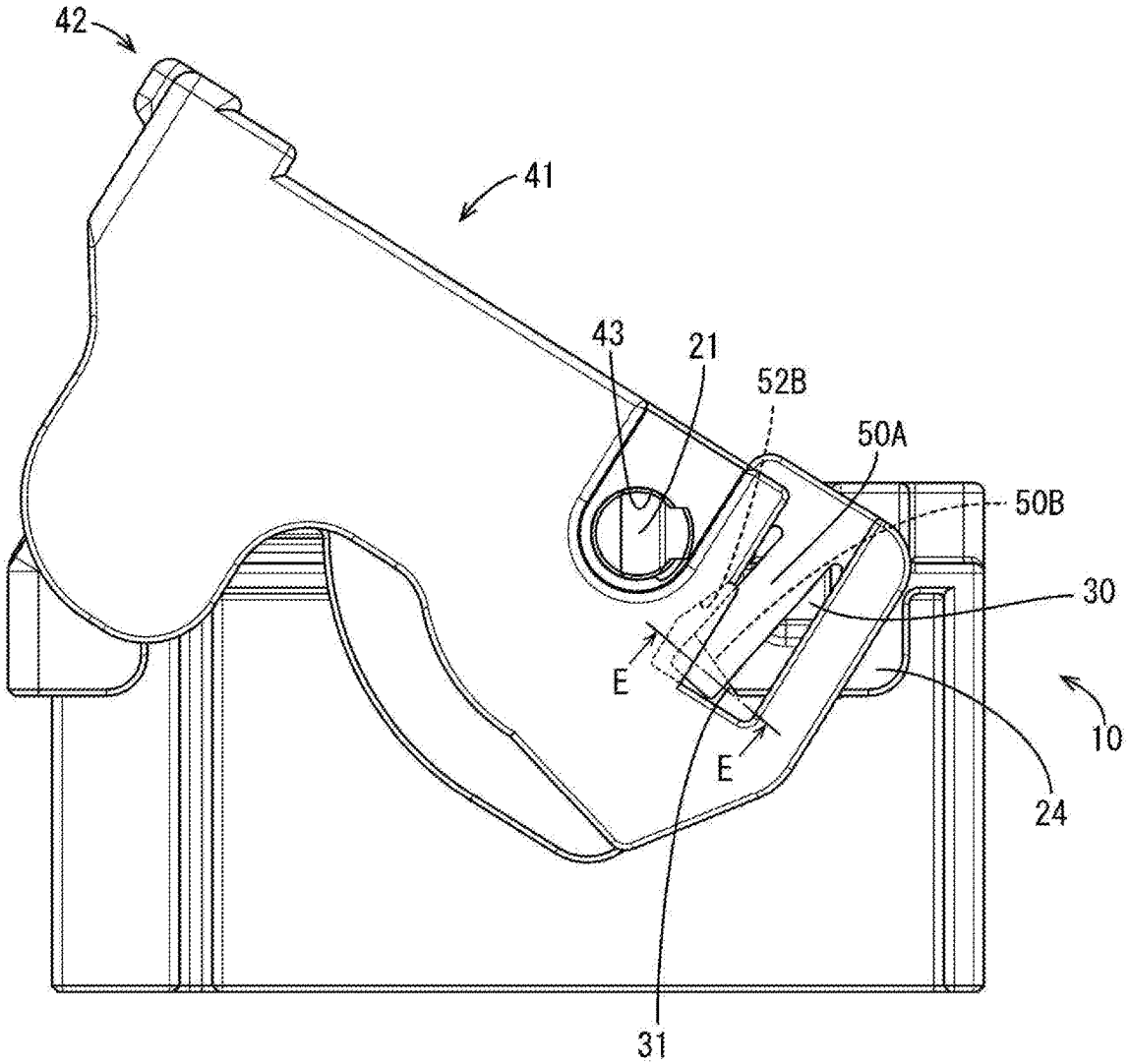
FIG. 20 is a view showing a state where the rotation of the lever is restricted.
Figure 21:
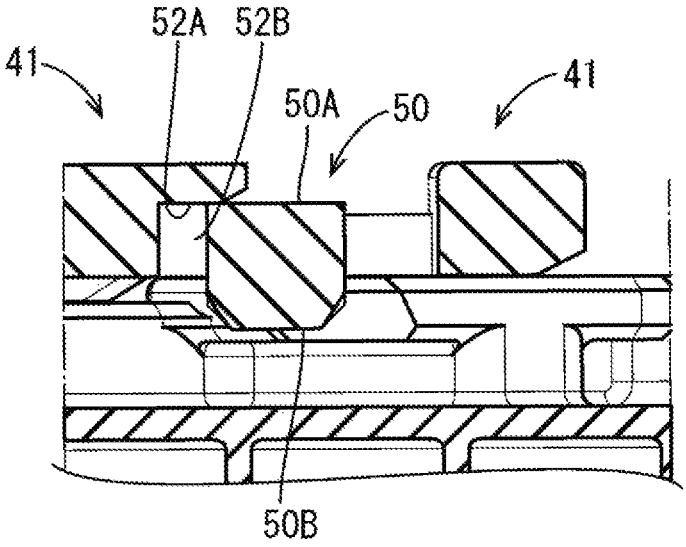
FIG. 21 is a section along E-E of FIG. 20.

Further, if it is attempted to further rotate the lever 40 toward the assemble end position despite this, the deflection pieces 50A of the locks 50 are deflected toward the lock covers 52 in plate surface directions of the arm plates 41 to be located relatively inwardly of the arm plates 41, as shown in FIGS. 20 and 21. Specifically, the deflection pieces 50A are covered by the ceilings 52A of the lock covers 52. In this way, the locks 50 cannot jump in a direction opposite to a direction toward the housing 10 by yielding to a force for forcibly rotating the lever 40 and locking between the lock claws 50B and the lock receiving portions 31 cannot be released inadvertently.

According to this configuration, the lever 40 is U-shaped, the ridge pieces 44 pass through the introducing portions 26 to butt against the front rails 22A to stop a forward movement if the lever 40 is behind the housing 10 to go around the wires and moved forward toward the housing 10. Subsequently, the ridge pieces 44 are moved laterally along the front rails 22A so that the lever 40 can be assembled at the assemble end position (i.e. connection position). If the lever 40 is rotated from the connection position to the connection initial position thereafter, the ridge pieces 44 are rotated to positions behind the housing 10 while passing through the escaping portions 28.

Accordingly, even if a sufficient space for arranging the lever 40 cannot be secured laterally to the housing 10, an assembling operation of the lever 40 can be guided from the position behind the housing 10 while the wires are avoided.

Further, in assembling the lever 40 from behind the housing 10, the lock claws 50B pass through the escaping portions 28 without interfering with the rear rails 22B. Thus, the lock claws 50B are not deformed or scraped.

Further, after passing through the escaping portions 28, the lock claws 50B pass through the introducing portions 29 without interfering with the front rails 22A. Thus, it can be further avoided that the lock claws 50B are deformed or scraped.

A modification according to this specification is described with reference to FIG. 22. Note that components corresponding to those of the above embodiment are denoted by reference signs of the embodiment plus 100. The same components, functions and effects as those of the embodiment are not described and the same components as those of the embodiment are denoted by the same reference signs.

Figure 22:
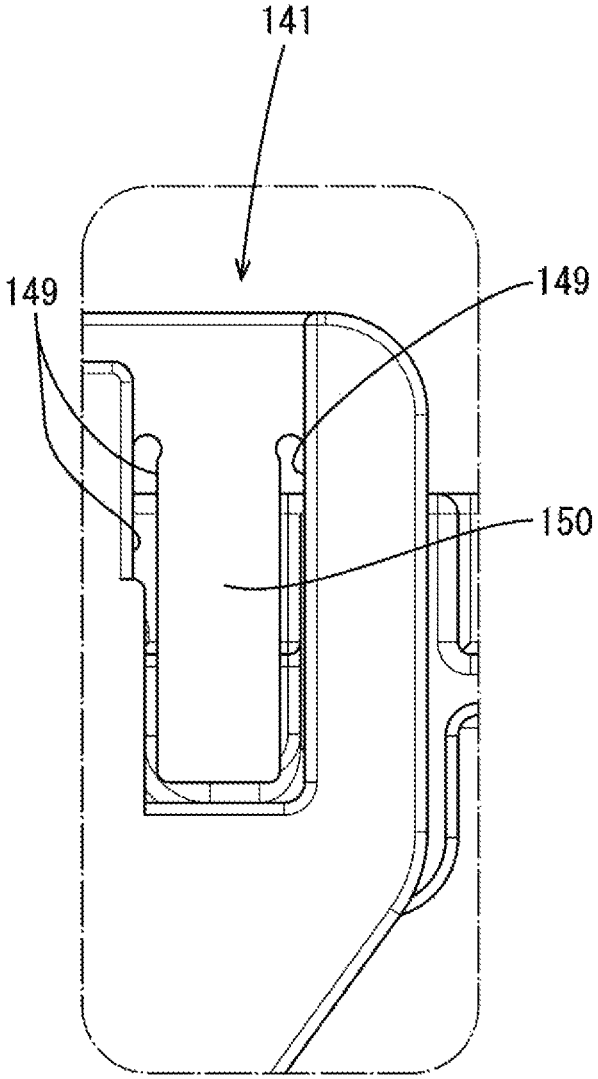
FIG. 22 is a view showing a modification of a lock portion.

The upper end of the slit 49 formed in the arm plate 41 has the semicircular shape having the diameter equal to the width of the slit 49 in the above embodiment, whereas an upper end of a slit 149 in FIG. 22 is formed into an arcuate shape having a diameter larger than a width of the slit 149, whereby a base end of a lock portion 150 is constricted. In this way, the lock portion 150 is easily deflected in a plate surface direction of an arm plate 141 and can easily slip under the arm plate 141 when a lever 40 is forcibly rotated from a connection initial position toward an assemble end position without a mating connector being externally fit after the lever 40 is disposed at the connection initial position. Thus, a locked state of the lock 150 and a lock receiving portion 31 can be reliably maintained.

A second modification according to this specification is described with reference to FIG. 23. Note that components corresponding to those of the above embodiment are denoted by reference signs of the embodiment plus 200. The same components, functions and effects as those of the embodiment are not described and the same components as those of the embodiment are denoted by the same reference signs.

The housing 10 of the above embodiment is a single body and the lever guide 70 is provided on each outer side surface 12 of the housing 10, whereas a housing 210 of this modification includes a first housing 210A and a second housing 210B. An introducing portion 226, a part of a front rail 222A, a part of a rear rail 222B and a part of a lateral guiding path 227 are provided on each outer side surface 212A of the first housing 210A. The part of the front rail 222A, a part of the rear rail 222B, a part of the lateral guiding path 227 and an escaping portion 228 are provided on each outer side surface 212B of the second housing 210B.

Figure 23:
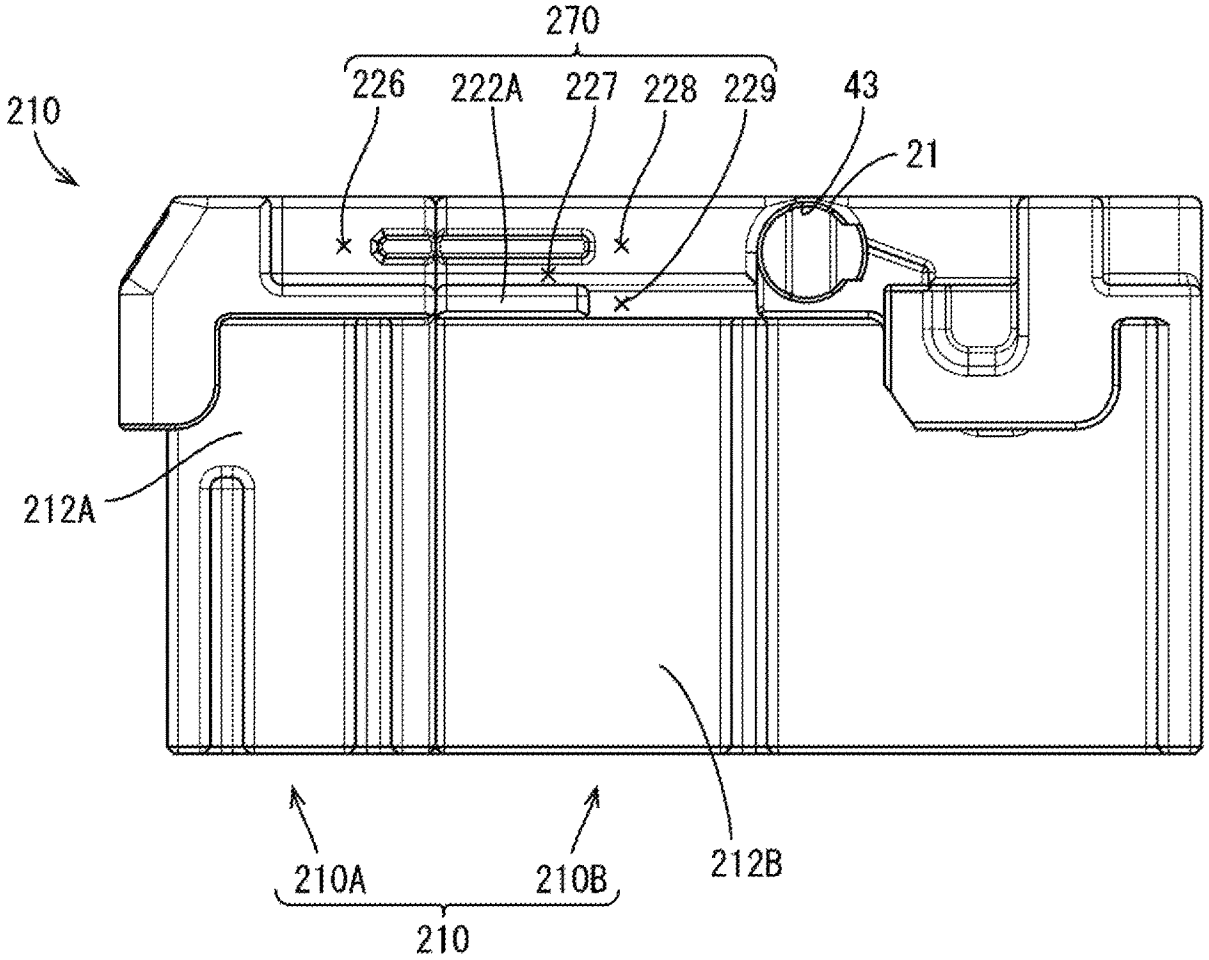
FIG. 23 is a view showing a modification of a housing.

These housings 210A, 210B are assembled such that the respective outer side surfaces 212A, 212B are arranged laterally side by side and flush with each other, whereby a lever guide portion 270 substantially similar to the lever guide portion 70 of the embodiment is formed as shown in FIG. 23. Specifically, the lever guide portion 270 is provided from the outer side surface 212A of the first housing 210A to the outer side surface 212B of the second housing 210B.

The invention is not limited to the above described and illustrated embodiment and can be embodied as follows.

The inclined receiving surface 45 is provided on the lateral end of the arm plate 41 and the inclined surface 21A is provided in the central part of the projecting end of the support shaft 21 in the lateral direction in the above embodiment. However, the positions of the inclined receiving surface and the inclined surface are not limited to these. For example, the inclined receiving surface may be on the inner surface side (surface side facing the other arm plate) of the arm plate and the entire projecting end of the support shaft may be formed into an inclined surface.

The lever 40 reaches the ride initial position while the guided portions (ridge pieces 44) are moving in the lateral guiding paths 27 by being guided by the guides 22 in the above embodiment. However, the lever 40 may reach the ride initial position when the guided portions reach final ends of the lateral guiding paths or further move in the same direction also thereafter by inertia.

Although the housing 10 is provided with the guides 22 and the lever 40 is provided with the guided portions 44 in the above embodiment, the guides 22 and the guided portions 44 may be omitted. Further, the assemble initial position and the ride initial position need not be different positions and may be the same position (i.e. the inclined receiving surfaces of the lever and the inclined surfaces of the support shafts are already in surface contact with each other at the assemble initial position).

The operating portion 42, the guided portion 44 and the shaft hole 43 are disposed side by side on the arm plate 41 in the above embodiment. However, the guided portion 44 may not be disposed side by side with the operating portion 42 and the shaft hole 43. For example, the guided portion 44 may be disposed at a position displaced forwardly from the operating portion 42 and the shaft hole 43 and the guide 22 of the housing 10 may also be disposed at a forward position to correspond to the guided portion 44. In short, it is sufficient that an arrangement direction of the operating portion and the shaft hole is substantially the same as the guiding direction of the guided portion by the guide.

Although the guide rails 22 are provided as the guide and the ridge piece 44 is provided as the guided portion in the above embodiment, other shapes of the guide and the guided portion are possible. For example, a semi-cylindrical body formed by coupling the front rail 22A and a part of the rear rail 22B located before the front rail on the respective projecting ends and open on both lateral sides may be provided as the guide and a cylindrical pin or a projecting body having another arbitrary shape may be provided as the guided portion.

Front and rear guide rails 22A, 22B are provided as the guide and one ridge piece 44 is provided as the guided portion 44 in the above embodiment. However, other configurations of the guide and the guided portion are possible. For example, front and rear rails may be provided as the guide, and two ridge pieces parallel to each other may be provided as the guided portion. The guide and the guided portion may be configured to guide each other with the rails of the guide and the ridge pieces of the guided portion alternately disposed.

The closing protrusion 23 is provided laterally to the introducing portion 26 to restrict a displacement of the ridge piece 44 disposed on the introducing portion 26 in the lateral direction (direction perpendicular to the extending direction of the wires) in the above embodiment. However, the closing protrusion may not be provided.

The lock claw 50B passes through both the escaping portion 28 and the inserting portion 29 when the lever 40 is at the initial position with respect to the housing in the above embodiment. However, the inserting portion may not be provided if the front rail does not interfere with the lock claw.

Although the lever 40 is provided with the locks 50 for holding the lever 40 at the connection initial position in the above embodiment, the locks may not be provided.

Although the clearance formed by opening the left end side of the rear rail 22B serves as the introducing portion 26 in the above embodiment, a contact rail adjacent to the left end of the rear rail 22B and in the form of a ridge having such a height as to be slightly contacted by the ridge piece 44 may project in the opening at the introducing portion. This enables the confirmation that the lever is correctly arranged at the assemble initial position by a feeling felt when the ridge piece moves over the contact rail, for example, in arranging the lever at the initial position. Further, an escaping rail having such a height as to be contacted slightly by the ridge piece and in the form of a ridge configured not to contact the lock claw may be project in the opening formed as the escaping portion on the right end side of the rear rail 22B at the escaping portion. In this way, the ridge piece slightly comes into contact to temporarily restrict a rearward displacement with the lever arranged at the assemble end position. Therefore, the lever is not rotated inadvertently rearward by a slight force.

LIST OF REFERENCE SIGNS

10, 210: housing
40: lever
41, 141: arm plate
41A: facing surface
44: ridge piece (guided portion)
70, 270: lever guide
22: guide (front and rear rails)
26: introducing portion
28: escaping portion
29: inserting portion
50: lock
50A: deflection piece
50B: lock claw

What is claimed is:

1. A lever-type connector, comprising:

a housing;

a lever rotatably mounted on the housing and rotatable between an initial position and a connection position; and wires pulled out rearward from the housing;

the lever-type connector being connectable to a mating connector by rotating the lever from the initial position to the connection position;

wherein:

the lever is U-shaped and has two arm plates coupled by an operating portion, the arm plates having facing surfaces that face one another and a ridge piece disposed on the facing surface of at least one of the two arm plates;

the housing includes a fitting portion fittable to the mating connector and a lever guide provided behind the fitting portion; and the lever guide includes:

front and rear rails extending in a direction perpendicular to a pull-out direction of the wires, the front and rear rails being substantially parallel and spaced from one another to define a lateral guiding path between the front and rear rails, the lateral guiding path being dimensioned to receive and guide the ridge piece from a first end of the lateral guiding path toward a second end of the lateral guiding path, the lever being assembled at the connection position when the ridge piece passes the second end of the lateral guiding path;

an introducing portion open on a first end of the rear rail and configured to introduce the ridge piece into the lateral guiding path between the rails from a position behind the housing; and an escaping portion open on a second end of the rear rail and configured to rotate the ridge piece to a position behind the housing as the lever is rotated from the connection position to the initial position.

2. The lever-type connector of claim 1, wherein:

a lock configured to hold the lever at the initial position is provided on the facing surface of at least one of the two arm plates and includes a deflectable deflection piece and a lock claw provided on a tip of the deflection piece; and the lock claw moves forward through the escaping portion from the position behind the housing as the ridge piece is introduced between the rails through the introducing portion from the position behind the housing.

3. The lever-type connector of claim 2, wherein:

an inserting portion configured to allow the lock claw to pass therethrough is provided on a second end part of the front rail; and the lock claw having moved forward through the escaping portion from the position behind the housing further moves forward through the inserting portion.

* * * * *